United States Patent [19]

Walsh

[11] Patent Number: 4,499,404

[45] Date of Patent: Feb. 12, 1985

[54] INCANDESCENT LAMP WITH CERAMIC BASE

[75] Inventor: LaVerne E. Walsh, Chagrin Falls, Ohio

[73] Assignee: General Electric Company, Schenectady, N.Y.

[21] Appl. No.: 405,650

[22] Filed: Aug. 5, 1982

[51] Int. Cl.[3] ..... H01K 1/46; H01K 1/50; H01R 33/74

[52] U.S. Cl. ..... 313/579; 313/318; 339/144 T

[58] Field of Search ..... 313/579, 569, 318; 339/144 T, 145 T

[56] References Cited

U.S. PATENT DOCUMENTS

| | | | |
|---|---|---|---|
| 2,802,133 | 8/1957 | Haas | 313/318 |
| 3,286,255 | 11/1966 | Sanchez . | |
| 3,314,331 | 4/1967 | Wiley | 313/318 X |
| 3,622,832 | 11/1971 | Schlessel et al. | 313/579 X |
| 3,749,960 | 7/1973 | Fuqua et al. | 313/318 |
| 3,852,631 | 12/1974 | Evans | 313/318 |
| 3,859,554 | 1/1975 | Preziosi et al. | 313/315 |
| 4,084,112 | 4/1978 | Hebert et al. | 313/318 X |
| 4,238,705 | 12/1980 | Thomas | 313/318 X |
| 4,409,516 | 10/1983 | Thomas et al. | 313/579 |

*Primary Examiner*—Palmer Demeo

*Attorney, Agent, or Firm*—John F. McDevitt; Philip L. Schlamp; Fred Jacob

[57] ABSTRACT

An electrically insulative base for an incandescent lamp is disclosed having a two-part construction with the individual base parts being joined together in butt-seal engagement along a horizontal plane transverse to the longitudinal lamp axis. Said base construction is especially useful in the tungsten halogen cycle lamps of the high wattage type requiring that a ceramic material be used and whereby the ceramic base parts are joined together before lamp assembly with a ceramic sealing material.

7 Claims, 2 Drawing Figures

INCANDESCENT LAMP WITH CERAMIC BASE

BACKGROUND OF THE INVENTION

Two-part base construction for incandescent lamps is known such as disclosed in U.S. Pat. No. 3,852,631, assigned to the assignee of the present invention. In said prior art base constructions, the individual base parts have been formed in two half sections made of insulating material and which are joined together generally with external fastening means along the longitudinal lamp axis. While this type base construction facilitates ease of assembly during lamp manufacture, the length of the base parts formed in half sections often leads to physical distortion when these parts are manufactured as well as poor registration between the half sections during lamp manufacture.

The above indicated problems with two-part lamp base constructions are increasingly severe when the base is constructed with a ceramic material. More particularly, the firing of a ceramic material increases physical distortion so that controlling physical dimensions of a half section base part becomes increasingly difficult and which can lead to failure of the half sections to meet properly when joined together. The advantages of two-part base constructions are thereby largely lost when a ceramic material is required and which has resulted in use of a single base member requiring that a central cavity be machined in said member to physically support the vitreous lamp envelope.

It would be desirable to reduce difficulties still being experienced with two-part base constructions for incandescent lamps which are made of an electrically insulative material. It would be further desirable to form these base parts in a manner eliminating need for machining the aforementioned central cavity now customarily employed in the base member for this type of lamp as well as permit the base parts to be assembled together before final lamp manufacture. It would be further desirable to accomplish these objectives for this type lamp without undue modification or additional cost in either lamp or lamp base manufacture.

SUMMARY OF THE INVENTION

A novel two-part base construction for an incandescent lamp has now been discovered which provides the central cavity without machining when the two base parts have been assembled and is less subject to the aforementioned dimensional problems. More particularly, the improved two-part base for said type lamp is formed of an electrically insulated material joined together in butt-seal engagement along a horizontal plane transverse to the longitudinal lamp axis with one base part having a central cavity opening in which the press seal end of the lamp is disposed while the other base part contains longitudinal openings that physically support connector pins for the lamp. In a preferred embodiment, said improved base is formed of ceramic material with the base parts being joined together with ceramic sealing material before final lamp assembly. A representative incandescent lamp utilizing the presently improved two-part base construction thereby comprises:

(a) a transparent vitreous envelope containing a resistive incandescent filament connected to a pair of conductive inleads hermetically sealed to the vitreous envelope in a press seal region at one end of said envelope;

(b) external connector pins secured to said lamp inleads to provide electrical current to said lamp; and (c) a two-part base for said lamp formed of electrically insulative material joined together in butt-seal engagement along a horizontal plane transverse to the longitudinal lamp axis with one base part having the central cavity opening in which the press seal end of said lamp is disposed while the other base part contains longitudinal openings which physically support said connector pins.

In a preferred lamp embodiment, the vitreous envelope is glass and refractory metal inleads are employed, generally tungsten metal, which are further joined to larger diameter refractory metal inlead wires in the press seal region of said glass envelope for connection to the externally located connector pins.

The principal advantages of the present two-part base construction are best illustrated in tungsten halogen cycle type incandescent lamps of relatively high wattage requiring that the lamp base be constructed with a ceramic material to provide the required strength, thermal endurance and electrical insulative properties for lamp operation over extended time periods. This type incandescent lamp has widespread use in studio, theater, and television lighting applications. The high wattage rating of such lamps, up to around 2,000 watts, has required that the ceramic base construction not only be of a relatively heavy nature to provide adequate physical support for a relatively large size lamp envelope containing a multifilament, resistive element and associated mount, but that metal pins which are inserted into the ceramic base member provide the means for supplying electrical current to the resistive filament in said lamp. A typical lamp of this type incorporating the presently improved part ceramic base comprises:

(a) a transparent vitreous envelope containing a resistive tungsten filament connected to a pair of refractory metal inleads hermetically sealed to the vitreous envelope in a press seal region at one end of said envelope;

(b) external metal connector pins secured to said lamp inleads to provide electrical current to said lamp; and (c) an inert gas filling within said vitreous envelope which contains sufficient halogen to produce the halogen cycle during lamp operation;

(d) wherein the improvement comprises having two base parts sealed together in butt-seal engagement along a horizontal plane transverse to the longitudinal lamp axis by means of ceramic sealing material with one base part having a central cavity opening in which the press seal end of said lamp is disposed while the other base part contains longitudinal openings which physically support said connector pins; and (e) ceramic sealing material being disposed in the central cavity of said lamp base to secure the press seal end of said lamp in said cavity.

As will be further explained in connection with the hereinafter preferred embodiment for said lamp construction, the ceramic sealing material that is disposed in the central cavity of said improved lamp base member provides substantial physical support to the lamp envelope end inserted into the central cavity by reason of the free space not being occupied by said lamp envelope end.

DETAILED DESCRIPTION OF THE PREFERRED EMBODIMENT

Figure 1:
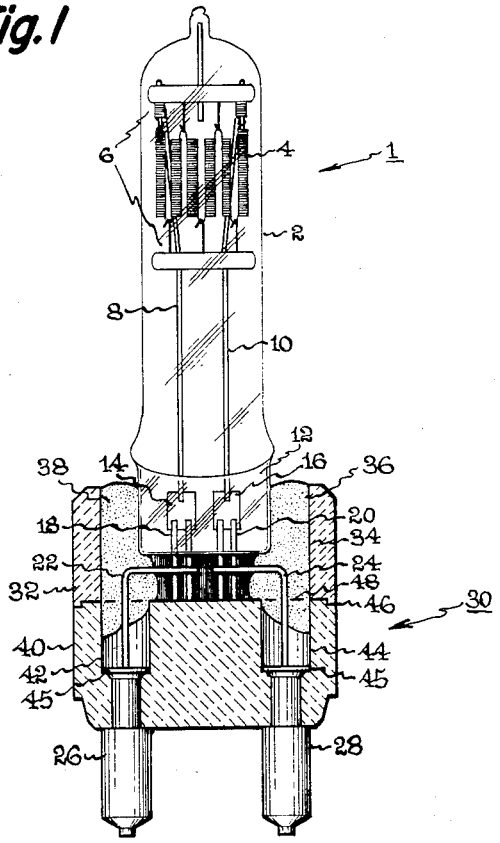
FIG. 1 is a plan view of a tungsten halogen cycle lamp produced in accordance with the invention.

Referring to FIG. 1, a representative tungsten-halogen cycle lamp 1 corresponding to a 1,500 watt, 120-volt size is illustrated which comprises a vitreous glass envelope 2 of tubular form that encloses a multifilament incandescent lamp coil 4 which is suspended from a conventional filament mount 6. A pair of refractory metal inleads 8 and 10 provides the means of furnishing electrical energy to said filament coil which are hermetically sealed at one end of the tubular-shaped lamp glass envelope by a direct vacuum-type pinch seal 12 and with the opposite ends of said lead-in wires being joined to conventional foil elements 14 and 16, respectively, to insure that vacuum-type sealing takes place. There is further provided in the press seal region two pair of larger diameter inlead wires 18 and 20 that are fixed to each of said foil elements to form part of the physical support structure of said lamp and which need not necessarily be hermetically sealed in the lamp construction. Said pair of larger diameter inlead wires are fixed at the opposite end to an external pair of further inleads 22 and 24, respectively, that provide additional physical support as well as electrical termination to a pair of connector pins 26 and 28 which are located in ceramic base member 30. Said ceramic base member is of two-part construction with upper part 32 including a central cavity opening 34 in which the press seal end 12 of said lamp is disposed allowing a free space 36 to remain in said cavity which is thereafter filled with ceramic sealing material 38 to secure the lamp envelope in the assembled base member along with providing substantial physical support to the lamp envelope in the assembled lamp. Lower ceramic base part 40 provides the means to close one end of said central cavity formed in upper base part 32 and contains a pair of longitudinal openings 42 and 44 into which connector pins 26 and 28, respectively, are inserted. A collar 45 at the end of each pin provides the means to physically support said pins in the longitudinal openings of said lower base part 40 when the base parts are joined together. The assembled base parts are shown to be joined together at parting line 46 and which further depicts the butt-seal engagement therebetween shown in phantom relief at 48.

Figure 2:
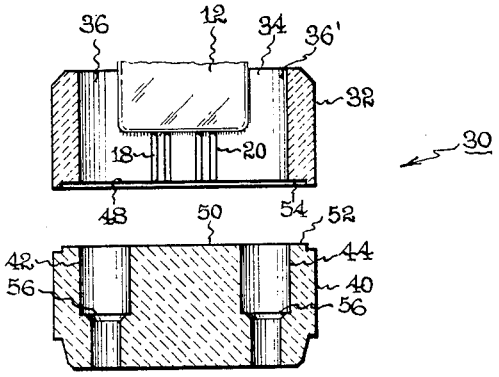
FIG. 2 is a more detailed plan view of the two-part base member employed in the FIG. 1 lamp embodiment before said parts have been assembled together.

In FIG. 2 there is shown in plan view the unassembled upper and lower base parts 32 and 40 for the base member 30 above described in the FIG. 1 lamp embodiment. Said upper base part 32 includes the central cavity 34 which supports pressed seal end 12 of the lamp when disposed therein and which has been shown for illustration purposes in perspective relief. A free space 36 and 36' exists on either side of said lamp envelope end after insertion into said cavity to enable ceramic sealing material (not shown) to be disposed in this free space during the final lamp assembly. Said ceramic material not only secures the lamp envelope to the assembled base in said manner but generally also flows downwardly into the connector pin area of the lower base part to electrically insulate the external inleads 18 and 20 as well. Lower base part 40 includes the spaced apart connector pin openings 42 and 44 along with a top sealing rim 50 for butt-seal engagement with said upper base part at parting line 48 when the two parts are joined together, preferably before final lamp assembly, with a ceramic sealing material (not shown). As can be noted, such assembly of the two-part base occurs in a horizontal plane transverse to the lamp longitudinal axis and with physical registration between the two base parts being provided with a raised step portion 52 on the lower base part which interfaces with a groove portion 54 located in the bottom edge of the upper base part. It can be further noted from the drawing that the central cavity opening becomes closed at its lower end when the two base parts are joined together and which thereafter permits the connector pins to be inserted into the openings for suspension at the ledges 56 provided in said openings and which can be followed by cementing the lamp envelope end to the base during final lamp assembly as previously described. It is preferred that the two base parts be joined together with ceramic sealing material which can be carried out in a single firing operation used to sinter the ceramic base parts in order to reduce the number of processing steps during final lamp assembly.

It will be apparent from the foregoing description that an improved two-part lamp base for incandescent lamps has been disclosed which is generally useful. It will be further apparent to those skilled in the lamp art, however, that said improved incandescent lamp base can be used with other type incandescent lamps other than above specifically described. For example, tungsten halogen cycle lamps having a different configuration are finding increasing use at sufficiently elevated wattages to require a ceramic base material such as in vehicle and outdoor lighting applications. Accordingly, it is intended to limit the present invention only by the scope of the following claims.

What I claim as new and desire to secure by U.S. Letters Patent is:

1. An incandescent lamp of the relatively high wattage type requiring a ceramic base which comprises:
   (a) a transparent vitreous envelope containing a multifilament incandescent lamp coil suspended from a filament mount and connected to a pair of conductive inleads hermetically sealed to the vitreous envelope in a press seal region at one end of said envelope;
   (b) external connector pins secured to said lamp inleads to provide electrical current to said lamp; and
   (c) a two-part base for said lamp formed of electrically insulative ceramic material joined together in butt-seal engagement along a horizontal plane transverse to the longitudinal lamp axis with one base part having a central cavity opening in which the press seal end of said lamp is disposed while the other base part contains longitudinal openings which physically support said connector pins.

2. An incandescent lamp as in claim 1 wherein the vitreous envelope is glass and the conductive inleads are refractory metal wires.

3. An incandescent lamp as in claim 2 wherein said inlead wires are joined to larger diameter inlead wires in the press seal region of said glass envelope.

4. A tungsten halogen cycle lamp of the relatively high voltage type with a two-part electrically insulative ceramic base which comprises:
   (a) a transparent vitreous envelope containing a multifilament incandescent lamp coil suspended from a filament mount and connected to a pair of refractory metal inleads hermetically sealed to the vitreous envelope in a press seal region at one end of said envelope;

(b) external metal connector pins secured to said lamp inleads to provide electrical current to said lamp;

(c) an inert gas filling within said vitreous envelope which contains sufficient halogen to produce the halogen cycle during lamp operation;

(d) wherein the improvement comprises having the two base parts sealed together in butt-seal engagement along a horizontal plane transverse to the longitudinal lamp axis by means of ceramic sealing material with one base part having a central cavity opening in which the press seal end of said lamp is disposed while the other base part contains longitudinal openings which physically support said connector pins; and (e) ceramic sealing material being disposed in the central cavity of said lamp base to secure the press seal end of said lamp in said cavity.

5. A lamp as in claim 4 wherein the vitreous envelope is glass and the refractory metal inleads are wires joined to larger diameter inlead wires in the press seal region of said glass envelope.

6. A lamp as in claim 4 wherein the central cavity opening of the lamp base is substantially greater than the space occupied by the press seal end of said lamp and the ceramic sealing material in said cavity provides physical support of the assembled components.

7. A lamp as in claim 4 wherein both connector pins include a collar at one end of each pin as the means to physically support said pins in the ceramic base.

* * * * *